US008167647B1

(12) United States Patent
Lee

(10) Patent No.: US 8,167,647 B1
(45) Date of Patent: May 1, 2012

(54) COAXIAL CONNECTOR

(76) Inventor: Chung-Yu Lee, Danshui Township, Taipei County (TW)

( * ) Notice: Subject to any disclaimer, the term of this patent is extended or adjusted under 35 U.S.C. 154(b) by 0 days.

(21) Appl. No.: 12/929,438

(22) Filed: Jan. 25, 2011

(51) Int. Cl.
*H01R 9/05* (2006.01)

(52) U.S. Cl. ..... 439/578; 439/352

(58) Field of Classification Search ..... 439/352–357, 439/578–585
See application file for complete search history.

(56) References Cited

U.S. PATENT DOCUMENTS 5,269,701 A * 12/1993 Leibfried, Jr. ..... 439/578
5,595,499 A * 1/1997 Zander et al. ..... 439/352
6,352,448 B1 * 3/2002 Holliday et al. ..... 439/585
6,805,583 B2 * 10/2004 Holliday et al. ..... 439/578
7,645,161 B2 * 1/2010 Holliday ..... 439/578

* cited by examiner

*Primary Examiner* — Khiem Nguyen
(74) *Attorney, Agent, or Firm* — Bacon & Thomas, PLLC

(57) ABSTRACT

A coaxial connector includes a clamping tube, which has a narrow body, a tapered head axially forwardly and radially outwardly extended from the narrow body, a stop flange extending around the periphery of the distal end of the tapered head, a retaining structure located on the inside of the distal end of the tapered head and longitudinal slits axially extending from the narrow body through the tapered head and the stop flange, and a chuck shell, which is sleeved onto the clamping tube and axially movable between the narrow body and the tapered head to force the retaining structure into engagement with the outer thread of the metal connection member of the complementary Female connector or to allow disengagement of the retaining structure from the outer thread of the metal connection member of the complementary Female connector.

8 Claims, 10 Drawing Sheets

COAXIAL CONNECTOR

BACKGROUND OF THE INVENTION

1. Field of the Invention

The present invention relates electrical connectors and more particularly to a coaxial connector for connecting a coaxial cable to a complementary male connector, which comprises a clamping tube having a tapered split head for attaching to a metal connection member of a complementary Female connector, and a chuck shell sleeved onto the clamping tube and axially movable onto or away from the tapered split head to force the tapered split head into engagement with an outer thread at the metal connection member of the complementary Female connector or to disengage tapered split head from the outer thread at the metal connection member of the complementary Female connector.

2. Description of the Related Art

Following fast development of communication technology, signal transmission requires high stability and rapid speed. In consequence, different communication wire materials, from the early flat cable design to the modern round cable and optical cable designs, have been created to enhance signal transmission speed and capacity. Subject to the application of telephone technology, video technology and internet technology, global communication becomes faster and cheaper. Transmission of video signal through a cable assures signal stability and reliability. Therefore, Cable TV is developed after the application of wireless TV and satellite TV. Establishing a Cable television system requires installation of cables between the provider and the subscribers. When a cable is extended to the inside of a house, a coaxial connector must be used to connect the cable to an indoor electric or electronic device.

FIG. 9 illustrates a cable end connector according to the prior art. According to this design, the cable end connector A comprises a base member A1, a tubular connection member A2 rotatably mounted on the front side of the base member A1 and defining therein a receiving chamber A21 and an inner thread A22 in the receiving chamber A21, a metal center pin A3 mounted in the base member A1 and axially forwardly extending though the receiving chamber A21 to the outside of the tubular connection member A2. The cable end connector A is adapted for receiving a complementary Female connector B, which comprises a connection member B1, which has an outer thread B11 for threading into the inner thread A22, and a tubular receptacle B2 axially located on the inside of the connection member B1 for receiving the metal center pin A3. After insertion of the metal center pin A3 into the tubular receptacle B2, the tubular connection member A2 of the cable end connector A is threaded onto the connection member B1 of the complementary Female connector B to fasten tight the outer thread B11 and the inner thread A22.

According to the aforesaid prior art design, the metal center pin A3 of the cable end connector A may be biased easily. During installation, the tubular connection member A2 must be accurately sleeved onto the connection member B1. However, because the inner diameter of the tubular connection member A2 is approximately lower than the outer diameter of the connection member B1, it will be difficult to keep the tubular connection member A2 in accurate alignment with the connection member B1 if the metal center pin A3 is biased. Thus, several trials may be necessary before accurate connection between the tubular connection member A2 and the connection member B1. Further, after accurate connection between the tubular connection member A2 and the connection member B1, the user must rotate the tubular connection member A2 relative to the connection member B1 through several turns to fasten tight the outer thread B11 and the inner thread A22 and to assure positive connection between the metal center pin A3 and the tubular receptacle B2. It is especially difficult to rotate the tubular connection member A2 into the connection member B1 within the narrow space. Thus, mounting and dismounting of this prior art design are inconvenient.

To improve the drawback of the aforesaid prior art design, another prior art cable end connector A is known. As illustrated in FIG. 10, this design of cable end connector A comprises a base member A1, a tubular connection member A2 fixedly connected to the front side of the base member A1 and having a plurality of longitudinal crevices A23 spaced around the periphery and extending to the front edge thereof, a receiving chamber A21 defined in the tubular connection member A2, a metal center pin A3 mounted in the base member A1 and axially forwardly extending though the receiving chamber A21 to the outside of the connection member A2. According to this design, the inner diameter of the tubular connection member A2 is slightly greater than the outer diameter of the connection member B1 of the complementary Female connector B so that the tubular connection member A2 can be easily and quickly be attached to the connection member B1 to have the metal center pin A3 be accurately inserted into the tubular receptacle B2. However, except for use in an indoor electronic device, the cable end connector A and the complementary Female connector B may be used outdoors. When used outdoors, the cable end connector A and the complementary Female connector B may be stretched to disconnect from each other accidentally by an external force, causing signal interruption. Thus, this design of cable end connector is inconvenient to use and requires maintenance frequently.

In order to avoid the problem of easy disconnection, the inner diameter of the tubular connection member A2 may be reduced and made slightly smaller than the outer diameter of the connection member B1 of the complementary Female connector B. By means of the design of longitudinal crevices A23, the tubular connection member A2 provides a clamping force to secure the inserted connection member B1 firmly in place, However, because the inner diameter of the tubular connection member A2 is slightly smaller than the outer diameter of the connection member B1 of the complementary Female connector B, much pressure must be applied to force the connection member B1 of the complementary Female connector B into the tubular connection member A2 of the cable end connector A after axial alignment between the metal center pin A3 and the tubular receptacle B2. However, when the user picks up the cable end connector A and the complementary Female connector B and attach the complementary Female connector B to the cable end connector A, the cable end connector A and the complementary Female connector B are usually not kept in accurate alignment. When applying a pressure to the complementary Female connector B to force the complementary Female connector B into the cable end connector A, the metal center pin A3 may be biased, complicating the installation.

Therefore, it is desirable to provide a coaxial connector, which facilitates quick and accurate mounting and dismounting.

SUMMARY OF THE INVENTION

The present invention has been accomplished under the circumstances in view. It is the main object of the present invention to provide a coaxial connector, which facilitates quick and accurate mounting and dismounting to connect a coaxial cable to a complementary Female connector or to disconnect the coaxial cable from the complementary Female connector.

To achieve this and other objects of the present invention, a coaxial connector is affixed to one end of a coaxial cable for fastening to an outer thread at a metal connection member of a complementary Female connector to electrically connecting the coaxial cable to the complementary Female connector. The coaxial connector comprises a clamping tube and a chuck shell. The clamping tube comprises a narrow body affixed to the coaxial cable, a tapered head axially forwardly and radially outwardly extended from the narrow body for clamping the metal connection member of the complementary Female connector, a receiving chamber surrounded by the tapered head for receiving the metal connection member of the complementary Female connector and having an inner diameter greater than the outer diameter of the outer thread at the metal connection member of the complementary Female connector, a retaining structure located on the distal end of the tapered head inside the receiving chamber and a plurality of longitudinal slits axially extending from the narrow body through the tapered head and the stop flange. The chuck sleeve is sleeved onto the clamping tube and axially movable relative to the clamping tube between the narrow body and the tapered head. The chuck sleeve has an inner diameter smaller than the outer diameter of the distal end of the tapered head of the clamping tube. When the chuck sleeve is moved from the narrow body of the clamping tube to the distal end of the tapered head, the tapered head is compressed to force the retaining structure into engagement with the outer thread at the metal connection member of the complementary Female connector. When the chuck sleeve is moved from the distal end of the tapered head to the narrow body, the distal end of the tapered head is released from the constraint of the chuck sleeve to disengage the retaining structure from the outer thread at the metal connection member of the complementary Female connector subject to the effect of the resilient material property thereof.

Further, the clamping tube comprises a stop flange outwardly extending around the distal end of the tapered head remote from the narrow body for stopping the chuck shell at the distal end of the tapered head.

Further, the chuck shell comprises a front extension movable with the chuck shell along the clamping tube onto and away from the tapered head of the clamping tube. The front extension has an outer diameter relatively smaller than the chuck shell and an inner diameter equal to the chuck shell. This design facilitates connection of the coaxial connector to a metal connection member of a complementary Female connector in a hole in an electronic apparatus.

Further, the chuck shell comprises a non-slip grip portion located on the periphery thereof to facilitate positive grip. The non-slip grip portion can be formed of a set of parallel grooves, crossed grooves, raised portions or raised stripes.

DETAILED DESCRIPTION OF THE PREFERRED EMBODIMENT

Figure 1:
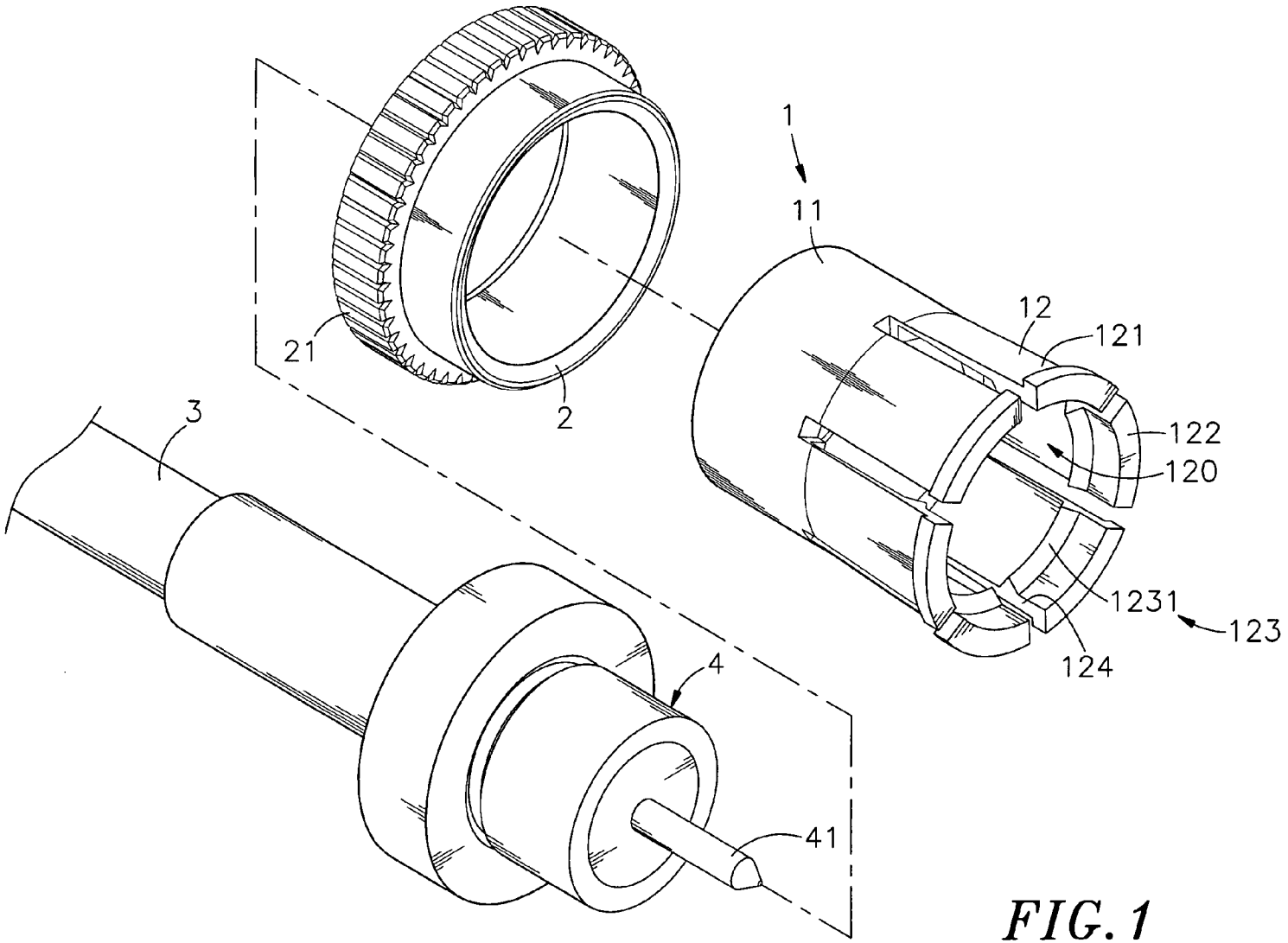
FIG. 1 is an exploded view of a coaxial connector in accordance with a first embodiment of the present invention.

Referring to FIGS. 1~3 and FIGS. 7 and 8, a coaxial connector in accordance with the present invention is shown comprising a clamping tube 1 and a chuck shell 2.

The clamping tube 1 is a metal tubular member having a narrow body 11 fixedly fastened to one end of a coaxial cable 3, a through hole 111 surrounded by the narrow body 11 for the passing of the center conductor 31 of the coaxial cable 3, a tapered head 12 axially forwardly and radially outwardly extended from the narrow body 11 for clamping a metal connection member 51 of a complementary Female connector 5, a receiving chamber 120 surrounded by the tapered head 12 for receiving the metal connection member 51 of the complementary Female connector 5, a stop flange 122 outwardly extending around the distal end 121 of the tapered head 12 remote from the narrow body 11, a retaining structure 123, for example, at least one ring tooth 1231 extending around the inside wall of the distal end 121 of the tapered head 12, and a plurality of longitudinal slits 124 axially extending from the narrow body 11 through the tapered head 12, the stop flange 122 and the ring tooth 1231 and equiangularly spaced from one another. Further, the inner diameter D1 of the receiving chamber 120 is greater than the outer diameter D of the metal connection member 51 of the complementary Female connector 5.

The chuck shell 2 is metal ring or any hard plastic ring member sleeved onto the tapered head 12, having an inner diameter D3 slightly smaller than the outer diameter D2 of the distal end 121 of the tapered head 12 and adapted for compressing the distal end 121 of the tapered head 12 to force the at least one ring tooth 1231 the retaining structure 123 into positive engagement with an outer thread 511 at the metal connection member 51 of the complementary Female connector 5. Further, the chuck shell 2 has a non-slip grip portion 21 located on the periphery, for positive gripping by the user. The non-slip grip portion 21 can be formed of parallel grooves, crossed grooves, raised portions or raised stripes.

Referring to FIG. 4 and FIGS. 1~3 again, the coaxial connector further comprises a cable end connection member 4 affixed to one end of the coaxial cable 3 to secure the clamping tube 1 in place. The cable end connection member 4 has a metal center pin 41 electrically connected with the center conductor 31 of the coaxial cable 3. After fixation of the narrow body 11 of the clamping tube 1 to the cable end connection member 4, the metal center pin 41 is inserted through the through hole 111 of the narrow body 11 into the receiving chamber 120 inside the tapered head 12 of the clamping tube 1.

Figure 2:
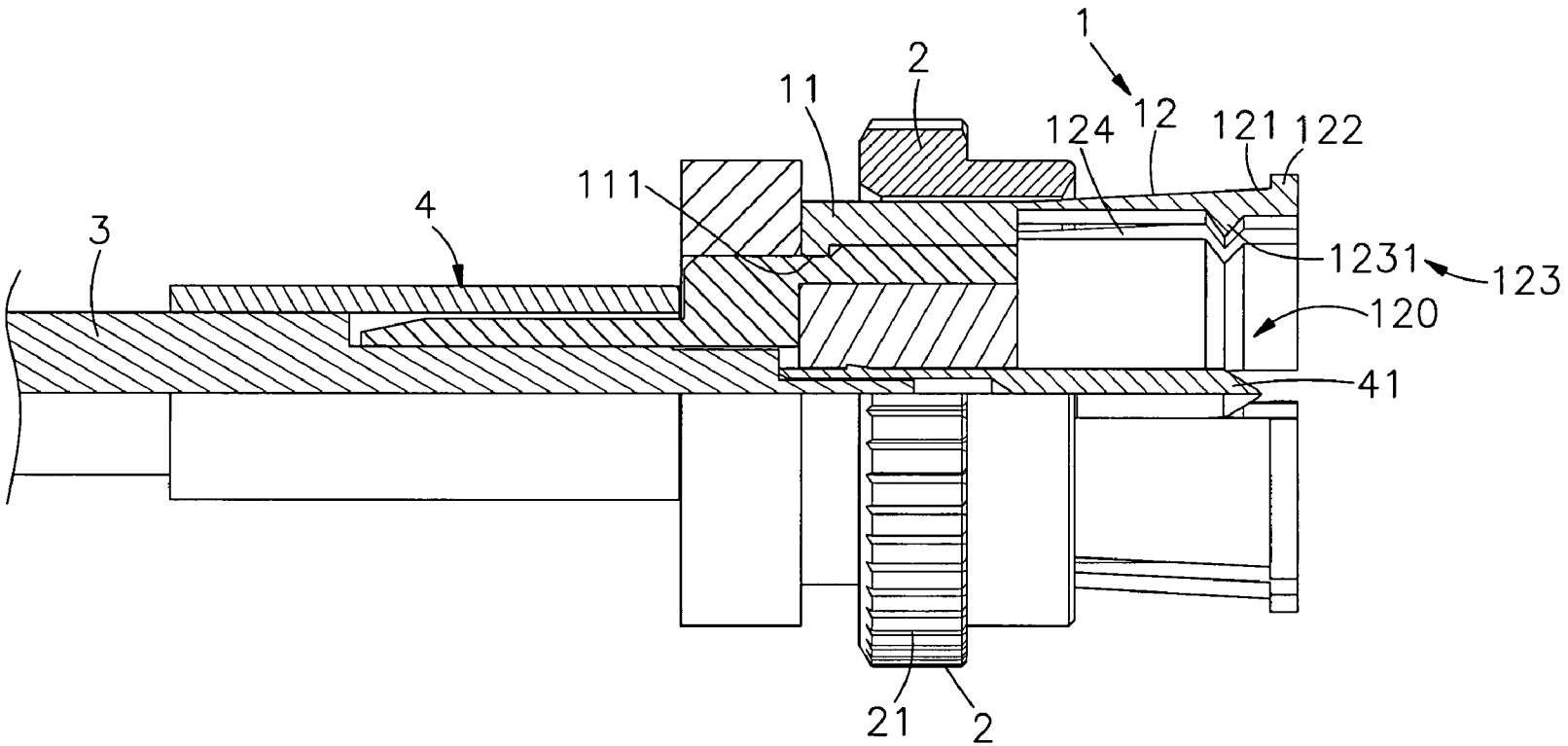
FIG. 2 is a sectional side view of the coaxial connector in accordance with the first embodiment of the present invention.
Figure 3:
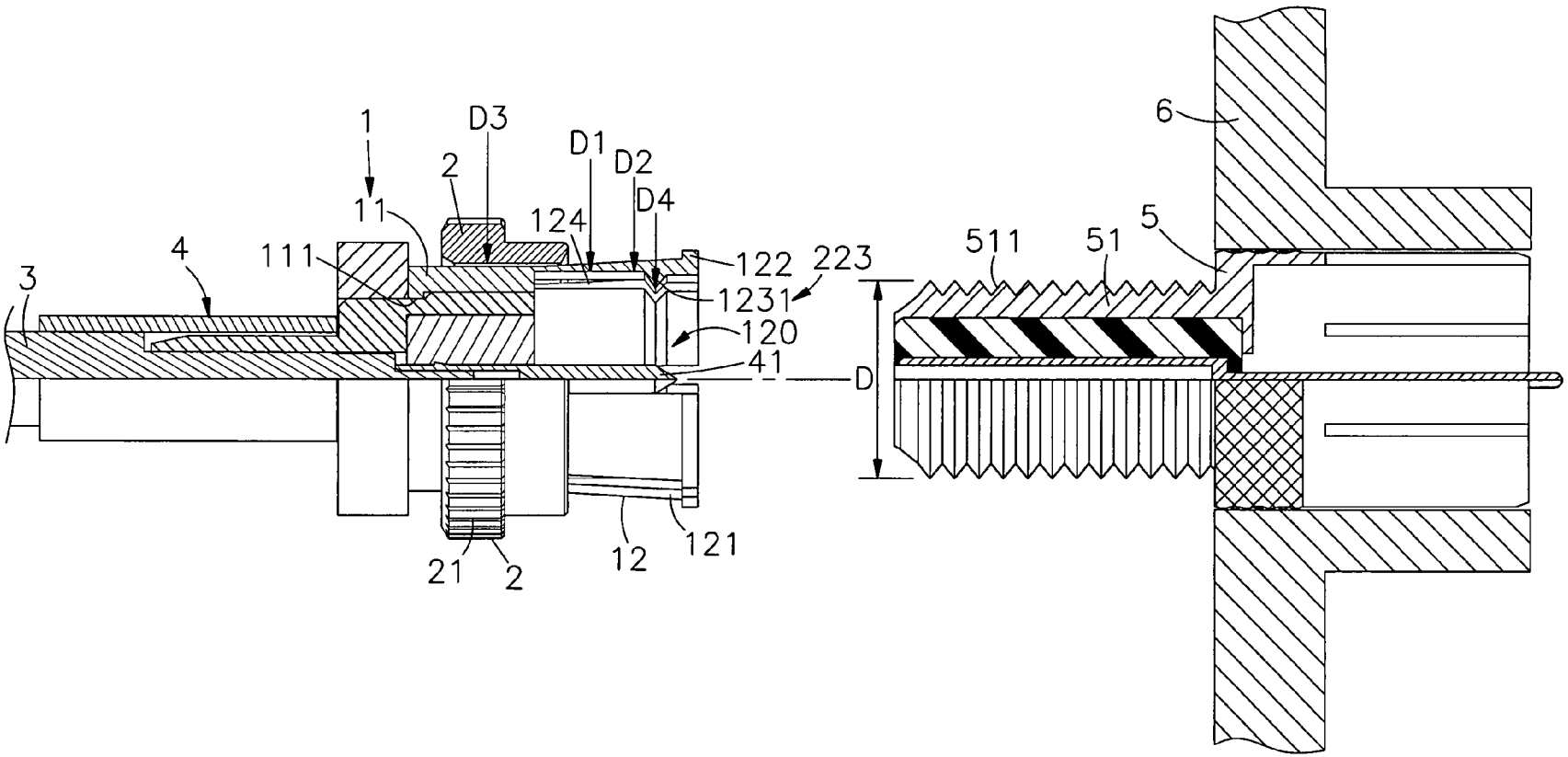
FIG. 3 is an applied view in section of the present invention before connection of the complementary coaxial connector.
Figure 4:
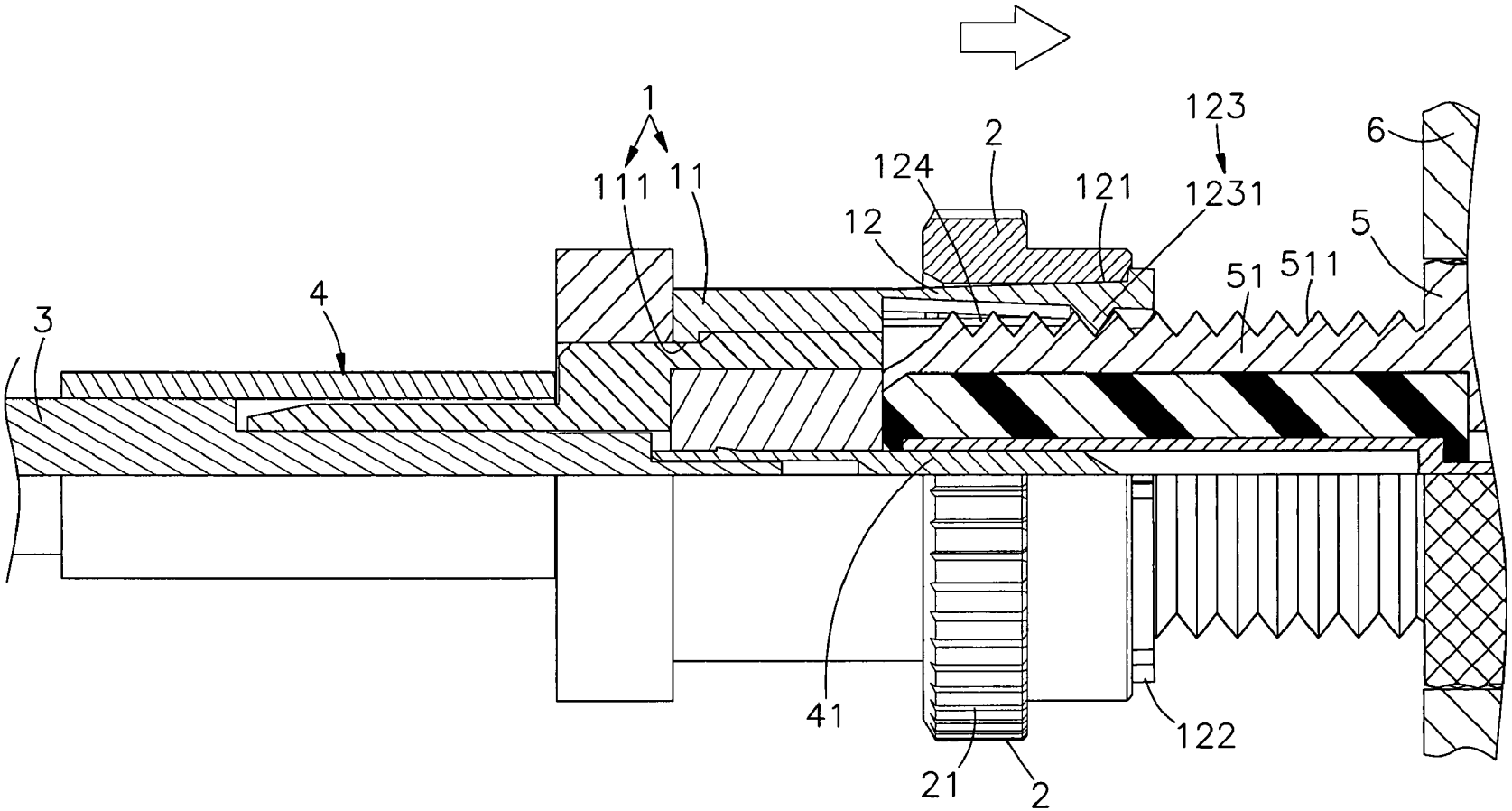
FIG. 4 is an applied view in section of the present invention after connection of the complementary coaxial connector.

Referring to FIGS. 2~4 again, as stated above, the inner diameter D1 of the receiving chamber 120 is greater than the outer diameter D of the metal connection member 51 of the complementary Female connector 5; the tapered head 12 extends axially forwardly and radially outwardly from the narrow body 11. Further, the inner diameter D4 of the retaining structure 123 of the tapered head 12 is greater than the outer diameter D of the metal connection member 51 of the complementary Female connector 5. Therefore, when inserting the metal connection member 51 of the complementary Female connector 5 into the clamping tube 1 and attaching the female center conductor (not shown) in the metal connection member 51 to the metal center pin 41 of the cable end connection member 4, the outer thread 511 of the metal connection member 51 will not touch the retaining structure 123 of the tapered head 12 of the clamping tube 1, and therefore the metal connection member 51 can be smoothly inserted into the receiving chamber 120 of the clamping tube 1 and accurately attached to the metal center pin 41 of the cable end connection member 4.

After the tapered head 12 is sleeved onto the metal connection member 51 of the complementary Female connector 5, move the chuck shell 2 from the narrow body 11 of the clamping tube 1 toward the tapered head 12 to compress the distal end 121 of the tapered head 12, forcing the at least one ring tooth 1231 of the retaining structure 123 into positive engagement with the outer thread 511 at the metal connection member 51 of the complementary Female connector 5. Subject to the design of the longitudinal slits 124, the distal end 121 of the tapered head 12 is compressed to force at least one ring tooth 1231 of the retaining structure 123 into positive engagement with the outer thread 511 at the metal connection member 51 of the complementary Female connector 5 when the front edge of the chuck shell 2 is stopped against the stop flange 122 of the tapered head 12, and thus the metal connection member 51 of the complementary Female connector 5 is locked to the cable end connection member 4. Further, because the chuck shell 2 is stopped against the stop flange 122 of the tapered head 12, it will not fall from the tapered head 12 of the clamping tube 1. Therefore, the coaxial connector facilitates installation and will not be easily forced out of place by an external force.

Further, when wishing to disconnect the complementary Female connector 5 from the cable end connection member 4, forced the chuck shell 2 in direction from the tapered head 12 of the clamping tube 1 toward the narrow body 11 to release the compressive force from the distal end 121 of the tapered head 12. After release of the constraint of the chuck shell 2 from the distal end 121 of the tapered head 12 of the clamping tube 1, the distal end 121 of the tapered head 12 immediately returns to its former shape subject to the effect of the resilient material property of the clamping tube 1 to disengage the at least one ring tooth 1231 of the retaining structure 123 from the outer thread 511 at the metal connection member 51 of the complementary Female connector 5, for allowing removal of the complementary Female connector 5 from the cable end connection member 4 and the clamping tube 1.

Further, the aforesaid cable end connection member 4 can have a straight or angled design. Either of straight or angled design, the metal center pin 41 of the cable end connection member 4 is kept suspending in the receiving chamber 120 inside the tapered head 12 and adapted for electrically connecting the female center conductor in the metal connection member 51 of the complementary Female connector 5 to the center conductor 31 of the coaxial cable 3. As the design of the cable end connection member 4 is of the known art, no further detailed description in this regard is necessary.

Figure 5:
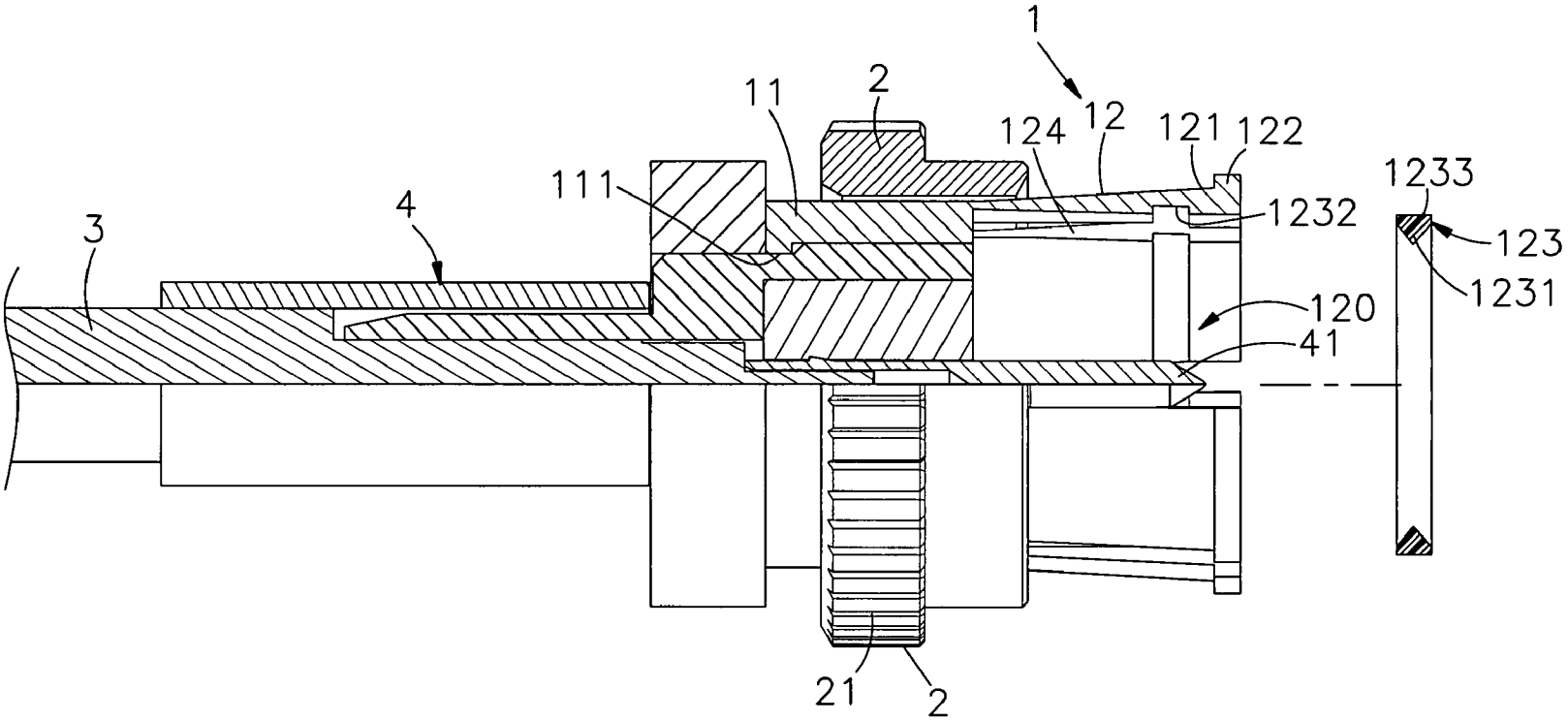
FIG. 5 is a sectional side view of a coaxial connector in accordance with a second embodiment of the present invention.

FIG. 5 illustrates an alternate form of the coaxial connector in accordance with the present invention. This embodiment is substantially similar to the embodiment shown in FIGS. 1-4 with the exception of the retaining structure 123. According to this alternate form, the retaining structure 123 comprises a locating groove 1232 extending around the inside wall of the distal end 121 of the tapered head 12, and an elastic retaining ring 1233 made of plastics or rubber and set in the locating groove 1232. The elastic retaining ring 1233 has at least one ring tooth 1231 located on the inside wall thereof for engaging the outer thread 511 of the metal connection member 51 of the complementary Female connector 5.

Figure 6:
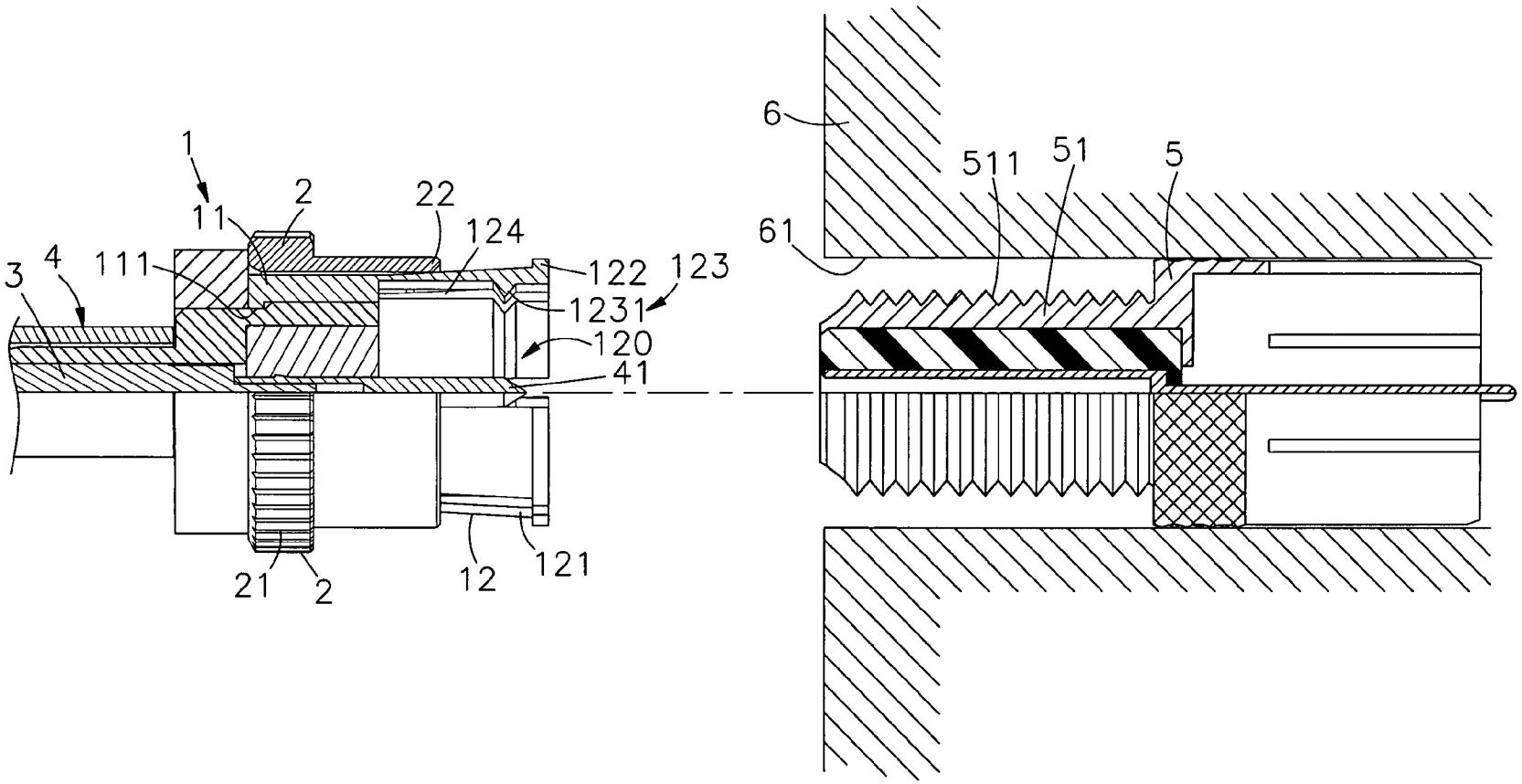
FIG. 6 is a coaxial connector in accordance with a third embodiment of the present invention.
Figure 7:
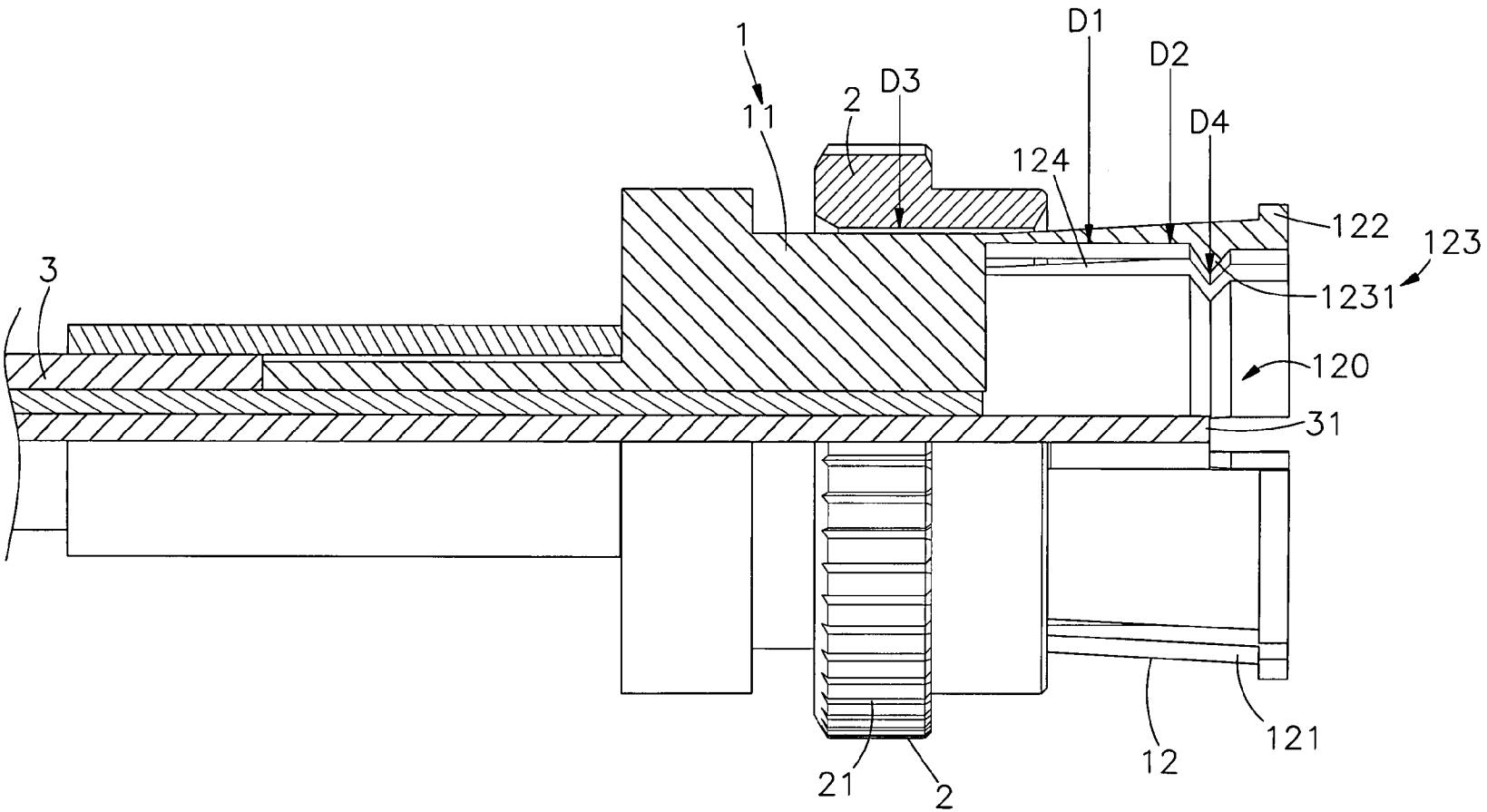
FIG. 7 is a coaxial connector in accordance with a fourth embodiment of the present invention.
Figure 8:
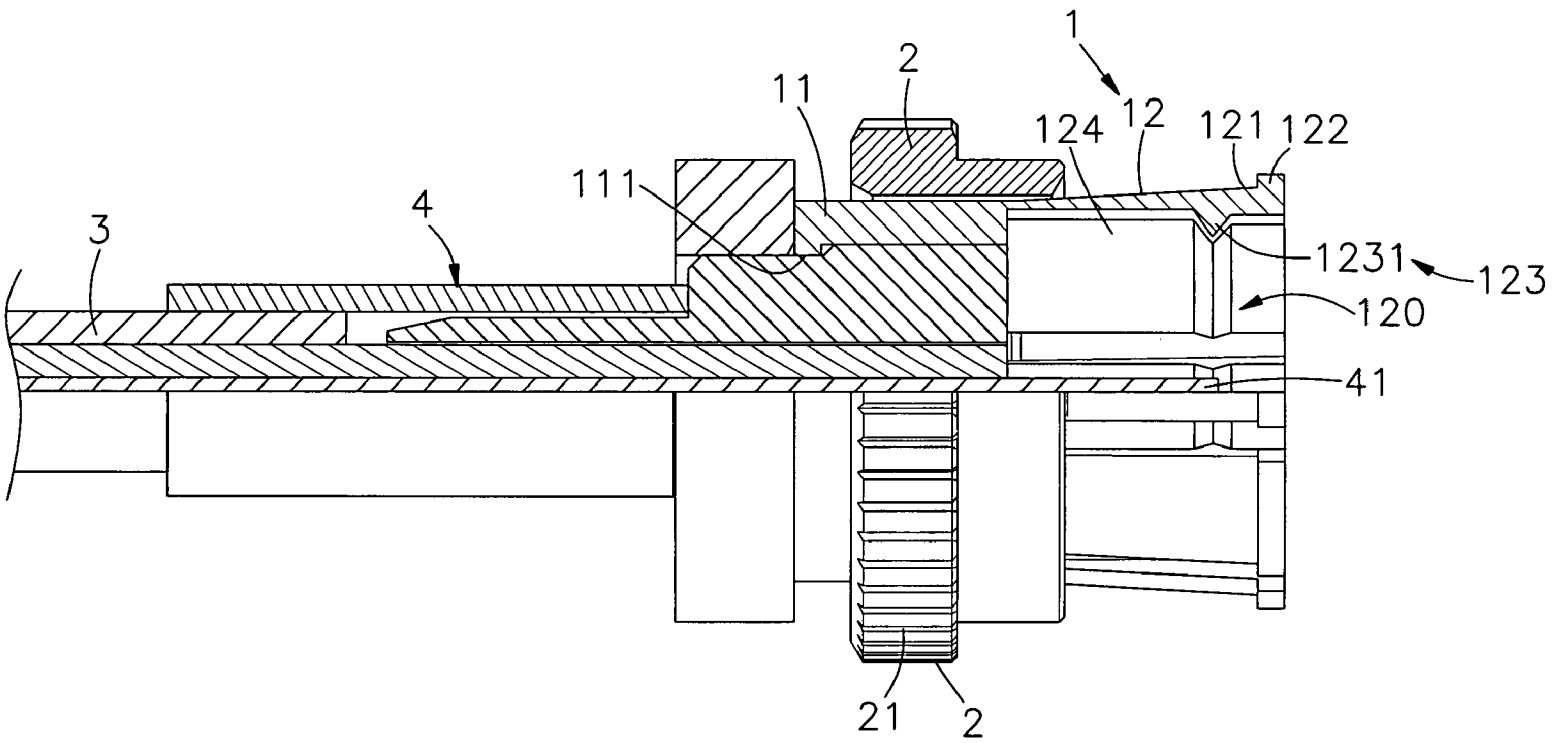
FIG. 8 is a coaxial connector in accordance with a fifth embodiment of the present invention.
Figure 9:
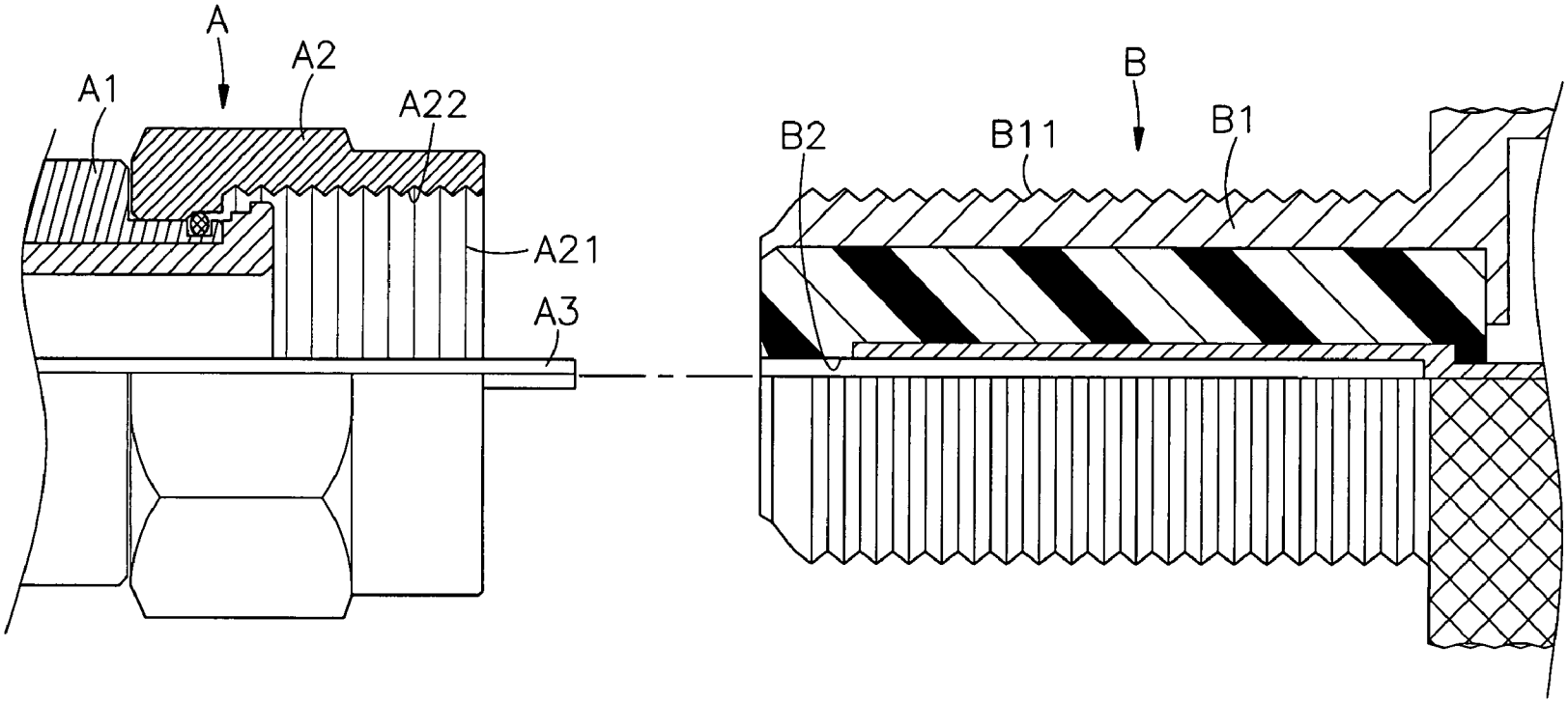
PRIOR ART FIG. 9
FIG. 9 is a sectional view of a cable end connector according to the prior art.
Figure 10:
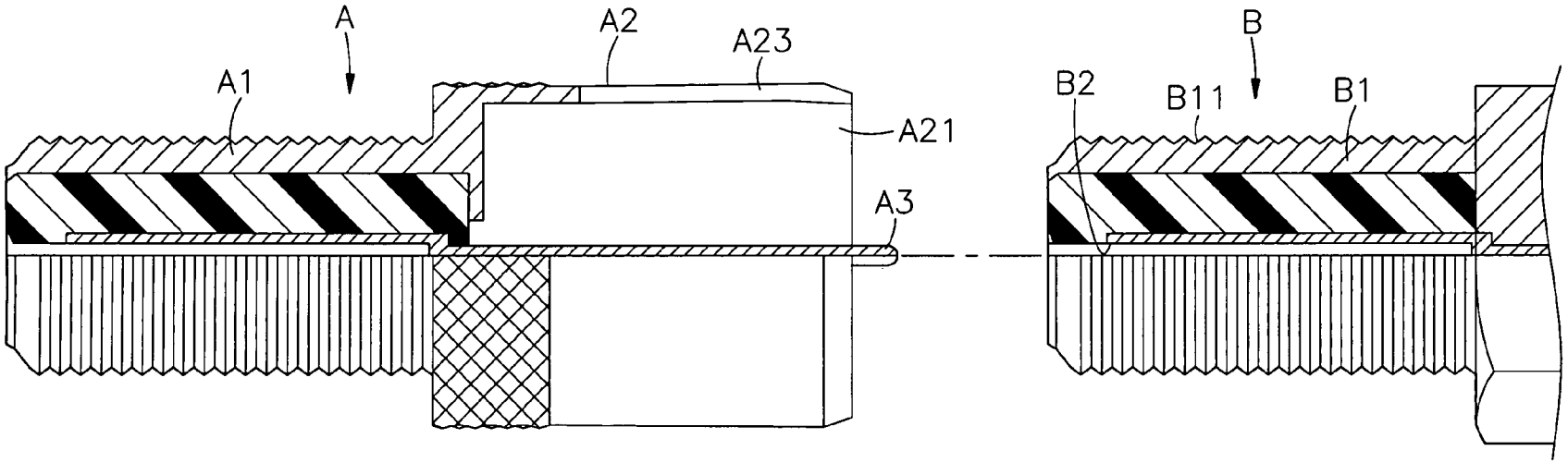
PRIOR ART FIG. 10
FIG. 10 is a sectional view of another structure of cable end connector according to the prior art.

Referring to FIG. 6 and FIG. 2 again, the complementary Female connector 5 may be installed in an electronic apparatus 6 to suspend the metal connection member 51 on the outside of the electronic apparatus 6 for the connection of the cable end connection member 4 and the clamping tube 1. Alternatively, the complementary Female connector 5 may be installed in the electronic apparatus 6 to suspend the metal connection member 51 in a hole 61 on the inside of the electronic apparatus 6. To fit this application, the chuck shell 2 is made having a front extension 22 of the same inner diameter. After insertion of the clamping tube 1 into the hole 61 on the inside of the electronic apparatus 6 and onto the metal connection member 51 of the complementary Female connector 5, push the chuck shell 2 forwardly relative to the clamping tube 1 to move the front extension 22 forwardly into contact with the stop flange 122 at the distal end 121 of the tapered head 12 of the clamping tube 1, thereby forcing the at least one ring tooth 1231 of the retaining structure 123 into engagement with the outer thread 511 of the metal connection member 51 of the complementary Female connector 5. After installation, the non-slip grip portion 21 of the chuck shell 2 is kept on the inside of the electronic apparatus 6 and accessible to the user.

In conclusion, the invention provides a coaxial connector, which has the advantages as follows:

1. The longitudinal slits 124 of the clamping tube 1 extend axially from the narrow body 11 through the tapered head 12, the stop flange 122 and the ring tooth 1231 and equiangularly spaced from one another and the retaining structure 123 is located on the inside wall of the distal end 121 of the tapered head 12 that extends axially forwardly and radially outwardly extended from the narrow body 11. After the clamping tube 1 is sleeved onto the metal connection member 51 of the complementary Female connector 5, the chuck shell 2 can be pushed forwards to compress the distal end 121 of the tapered head 12, forcing the retaining structure 123 into positive engagement with the outer thread 511 at the metal connection member 51 of the complementary Female connector 5.

2. The inner diameter D3 of the chuck shell 2 is slightly smaller than the outer diameter D2 of the distal end 121 of the tapered head 12; the outer diameter D2 of the distal end 121 of the tapered head 12 is greater than the outer diameter D of the outer thread 511 at the metal connection member 51 of the complementary Female connector 5; the inner diameter D4 of the retaining structure 123 of the tapered head 12 is greater than the outer diameter D of the metal connection member 51 of the complementary Female connector 5. Further, the longitudinal slits 124 of the clamping tube 1 extend axially from the narrow body 11 through the tapered head 12, the stop flange 122 and the ring tooth 1231. Therefore, when moving the chuck shell 2 forwardly toward the distal end 121 of the tapered head 12, the distal end 121 of the tapered head 12 will be compressed to force the retaining structure 123 into positive engagement with the outer thread 511 at the metal connection member 51 of the complementary Female connector 5 and to lock the coaxial cable 3 to the complementary Female connector 5.

3. By means of moving the chuck shell 2 backwardly from the distal end 121 of the tapered head 12 back to the narrow body 11, the distal end 121 of the tapered head 12 will be released from the constrain to disengage the retaining structure 123 from the outer thread 511 at the metal connection member 51 of the complementary Female connector 5, allowing removal of the coaxial cable 3 from the complementary Female connector 5.

4. The stop flange 122 at the distal end 121 of the tapered head 12 can stop the chuck shell 2 in place, avoiding falling of the chuck shell 2 out of the clamping tube 1.

5. The chuck shell 2 can be made having a front extension 22 so that when the clamping tube 1 is inserted into a hole 61 on the inside of an electronic apparatus 6 and sleeved onto an externally threaded metal connection member 51 of a complementary Female connector 5 in the electronic apparatus 6, the chuck shell 2 can be pushed to move the front extension 22 forwardly into the inside of the hole 61 and into contact with the stop flange 122 at the distal end 121 of the tapered head 12 of the clamping tube 1, thereby forcing the retaining structure 123 into engagement with the outer thread 511 of the metal connection member 51 of the complementary Female connector 5 to lock the connected coaxial cable 3 to the complementary Female connector 5. After installation, the non-slip grip portion 21 of the chuck shell 2 is kept on the inside of the electronic apparatus 6 and accessible to the user for allowing quick disconnection of the coaxial cable 3 from the complementary Female connector 5.

As stated above, the coaxial connector, which comprises a clamping tube 1 having a narrow body 11, a tapered head 12 axially forwardly and radially outwardly extended from the narrow body 11, a stop flange 122 extending around the periphery of the distal end 121 of the tapered head 12, a retaining structure 123 located on the inside of the distal end 121 of the tapered head 12 and longitudinal slits 124 axially extending from the narrow body 11 through the tapered head 12 and the stop flange 122, and a chuck shell sleeved onto the clamping tube 1 and axially movable between the narrow body 11 and the tapered head 12 to force the retaining structure 123 into engagement with the outer thread 511 of the metal connection member 51 of the complementary Female connector 5 or to allow disengagement of the retaining structure 123 from the outer thread 511 of the metal connection member 51 of the complementary Female connector 5.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A coaxial connector affixed to one end of a coaxial cable for fastening to an outer thread at a metal connection member of a complementary Female connector to electrically connecting said coaxial cable to said complementary Female connector, the coaxial connector comprising:

a clamping tube, said clamping tube comprising a narrow body affixed to said coaxial cable, a tapered head axially forwardly and radially outwardly extended from said narrow body for clamping the metal connection member of said complementary Female connector, a receiving chamber surrounded by said tapered head for receiving said metal connection member of said complementary Female connector, said receiving chamber having an inner diameter greater than the outer diameter of said outer thread at said metal connection member of said complementary Female connector, a retaining structure located on the distal end of said tapered head inside said receiving chamber and a plurality of longitudinal slits axially extending from said narrow body through said tapered head and a stop flange; and a chuck sleeve sleeved onto said clamping tube and axially movable relative to said clamping tube between said narrow body and said tapered head, said chuck sleeve having an inner diameter smaller than the outer diameter of said distal end of said tapered head of said clamping tube such that when said chuck sleeve is moved from said narrow body of said clamping tube to said distal end of said tapered head, said tapered head is compressed to force said retaining structure into engagement with said outer thread at said metal connection member of said complementary Female connector; when said chuck sleeve is moved from said distal end of said tapered head to said narrow body, said distal end of said tapered head is released from the constraint of said chuck sleeve to disengage said retaining structure from said outer thread at said metal connection member of said complementary Female connector.

2. The coaxial connector as claimed in claim 1, wherein said narrow body of said clamping tube defines therein a through hole for the passing of the center conductor of said coaxial cable into the inside of said receiving chamber.

3. The coaxial connector as claimed in claim 1, further comprising a cable end connection member affixed to one end of the coaxial cable to secure said clamping tube in place, said cable end connection member comprising a metal center pin electrically connected with the center conductor of said coaxial cable; said narrow body of said clamping tube is affixed to said cable end connection member around said metal center pin.

4. The coaxial connector as claimed in claim 1, wherein said clamping tube comprises a stop flange outwardly extending around said distal end of said tapered head remote from said narrow body for stopping said chuck sleeve at said distal end of said tapered head.

5. The coaxial connector as claimed in claim 1, wherein said retaining structure comprises at least one ring tooth formed integral with said distal end of said tapered head and suspending in said receiving chamber.

6. The coaxial connector as claimed in claim 1, wherein said retaining structure comprises a locating groove extending around an inside wall of said distal end of said tapered head inside said receiving chamber, and an elastic retaining ring set in said locating groove, said elastic retaining ring carrying said at least one ring tooth on an inside wall thereof for engaging said outer thread at said metal connection member of said complementary Female connector.

7. The coaxial connector as claimed in claim 1, wherein said chuck sleeve comprises a front extension movable with said chuck sleeve along said clamping tube onto and away from said tapered head of said clamping tube, said front extension having an outer diameter relatively smaller than said chuck sleeve and an inner diameter equal to said chuck sleeve.

8. The coaxial connector as claimed in claim 1, wherein said chuck sleeve comprises a non-slip grip portion located on the periphery thereof.

* * * * *